US009677403B2

(12) United States Patent
Stiehler et al.

(10) Patent No.: US 9,677,403 B2
(45) Date of Patent: Jun. 13, 2017

(54) SECUREMENT SYSTEM AND METHOD FOR SECURING AN ATTACHMENT PORTION OF AT LEAST ONE ROTOR BLADE OR ROTOR BLADE SEGMENT IN A MOUNTING SITE OF A ROTOR BASE

(71) Applicant: MTU Aero Engines AG, Munich (DE)

(72) Inventors: Frank Stiehler, Bad Liebenwerda (DE); Felix Kern, Eching (DE)

(73) Assignee: MTU Aero Engines AG, Munich (DE)

( * ) Notice: Subject to any disclaimer, the term of this patent is extended or adjusted under 35 U.S.C. 154(b) by 565 days.

(21) Appl. No.: 14/245,686

(22) Filed: Apr. 4, 2014

(65) Prior Publication Data

US 2014/0301854 A1 Oct. 9, 2014

(30) Foreign Application Priority Data

Apr. 4, 2013 (DE) ..... 10 2013 205 948

(51) Int. Cl.

| | |
|---|---|
| ***F04D 29/34*** | (2006.01) |
| ***F01D 5/02*** | (2006.01) |
| ***F01D 5/30*** | (2006.01) |
| ***F01D 5/32*** | (2006.01) |

(52) U.S. Cl.

CPC ..... *F01D 5/02* (2013.01); *F01D 5/3007* (2013.01); *F01D 5/323* (2013.01); *Y10T 29/4932* (2015.01)

(58) Field of Classification Search

CPC . F01D 5/02; F01D 5/3007; F01D 5/32; F01D 5/30; F01D 5/3015; F01D 5/303; F01D 5/3053; F01D 5/326; Y10T 29/4932

USPC ..... 416/221, 220 R, 219 R, 204 R

See application file for complete search history.

(56) References Cited

U.S. PATENT DOCUMENTS

| | | | | |
|---|---|---|---|---|
| 3,076,634 | A * | 2/1963 | Boyle | F01D 5/323 416/221 |
| 3,216,699 | A * | 11/1965 | Schoenborn | F01D 5/22 416/190 |
| 3,353,788 | A | 11/1967 | Weeds | |
| 3,653,781 | A * | 4/1972 | Cooper | F01D 5/323 416/221 |
| 4,478,554 | A * | 10/1984 | Surdi | F01D 5/323 416/220 R |

(Continued)

FOREIGN PATENT DOCUMENTS

| | | |
|---|---|---|
| DE | 15 51 202 B1 | 10/1970 |
| DE | 10 2011 084 153 A1 | 4/2013 |
| EP | 2 696 035 A1 | 2/2014 |

*Primary Examiner* — Craig J Price

(74) *Attorney, Agent, or Firm* — Crowell & Moring LLP

(57) ABSTRACT

A securement system for securing an attachment portion of at least one rotor blade or rotor blade segment in a mounting site of a rotor base. The securement system has at least one holder element and a second holder element, each of which has a holding portion and a connecting portion. The connecting portions can be introduced into the mounting site so as to establish a clip connection and can be locked together in the mounting site. The holding portions are configured so as to fasten the attachment portion of the at least one rotor blade or of the rotor blade segment in the mounting site in the locked state of the connecting portions. Further disclosed is a method for securing an attachment portion of at least one rotor blade or rotor blade segment in a mounting site of a rotor base and a rotor having a securement system.

13 Claims, 3 Drawing Sheets

(56) References Cited

U.S. PATENT DOCUMENTS

| | | | | |
|---|---|---|---|---|
| 7,625,174 | B2 * | 12/2009 | Drerup | F01D 9/041<br>415/135 |
| 2009/0060746 | A1 | 3/2009 | Barr, Jr. et al. | |
| 2011/0027090 | A1 | 2/2011 | Casavant et al. | |
| 2014/0301853 | A1 * | 10/2014 | Pernleitner | F01D 5/32<br>416/204 R |

* cited by examiner

SECUREMENT SYSTEM AND METHOD FOR SECURING AN ATTACHMENT PORTION OF AT LEAST ONE ROTOR BLADE OR ROTOR BLADE SEGMENT IN A MOUNTING SITE OF A ROTOR BASE

This application claims the priority of German Patent Document No. DE 102013205948.5, filed Apr. 4, 2013, the disclosure of which is expressly incorporated by reference herein.

BACKGROUND AND SUMMARY OF THE INVENTION

The work that led to this invention was supported under the Financial Aid Agreement as part of the Seventh Framework Program of the European Union (RP7/2007-2013).

The invention relates to a securement system and a method for securing an attachment portion of at least one rotor blade or rotor blade segment in a mounting site of a rotor base. The invention furthermore relates to a rotor having at least one such securement system.

A securement system can already be found, for example, in U.S. Patent Application Publication 2009/0060746 A1. To attach rotor blades to a rotor base, securement systems configured as so-called "retainer clips" are first installed in individual mounting sites of the rotor base. Then the rotor base is equipped with rotor blades in that the attachment portions of the rotor blades or rotor blade segments are inserted into the appropriate mounting sites. To secure the rotor blades or rotor blade segments, end portions of the individual securement systems are bent over to create a type of clamp around the attachment portion.

It must be viewed as a disadvantage of the known securement systems that in cases in which these retainer clips are damaged in the course of being bent over, the blades must be dismantled from the entire rotor base so as to replace the defective securement system. This results in significantly higher assembly costs and times.

The task of the present invention is to create a securement system of the type mentioned above that permits improved assembly and dismantling. Further tasks of the invention lie in creating an associated method for securing an attachment portion of at least one rotor blade or rotor blade segment in a mounting site of a rotor base, as well as a rotor having a corresponding securement system.

Advantageous configurations having useful further developments of the invention are further indicated in the description and claims, wherein advantageous configurations of the securement system are to be understood as advantageous configurations of the method or rotor, as the case may be, and vice versa.

A first aspect of the invention relates to a securement system for securing a fastening portion of at least one rotor blade or rotor blade segment in a mounting site of a rotor base. For better assembly and dismantling of the securement system, provision is made in accordance with the invention for the securement system to have at least one first holder element and one second holder element, each of which has a holding portion and a connecting portion. The connecting portions of the holder elements may be inserted into the mounting site to establish a clip connection and may be locked together in the mounting site. The holding portions of the holder elements are configured in such a way that in the locked-together state of the connecting portions they fasten the attachment portion of the at least one rotor blade or rotor blade segment in the mounting site. In other words, the invention provides for a two-part securement system, the two holder elements of which are clipped together to secure the rotor blade or rotor blade segment to the rotor base in the respective mounting site, the holding portions of the holder elements being configured in such a way that, in the mounted state of the holder elements, they bring about a fixation in place of the rotor blade or rotor blade segment concerned, without further work steps such as being bent over or the like. In this way an especially simple, fast and economical assembly of the securement system and a correspondingly simple, fast and economical securement of the rotor blade or rotor blade segment in place are enabled. In order to remove or replace the securement system, it is furthermore sufficient to release the clip connection between the holder elements. The disengaged holder elements can then easily be removed from the mounting site and, if applicable, replaced with new holder elements. In contrast to the background art, it is not necessary to remove all the blades from the entire rotor base, and substantial advantages are thus achieved in terms of time and cost. At the same time, the securement system is fundamentally independent from the necessary mounting direction, and may for example be applied in the axial or radial direction, from the front or from the back of the rotor base. After the clip connection has been established, the securement system continues to ensure a defined flow of forces.

An advantageous embodiment of the invention provides that the connecting portion of the first holder element comprises a shaft having at least one protruding snap-in nose that may be clipped into a clipping receptacle of the connecting portion of the second holder element in order to establish the clip connection. A simple and flexible possibility is thereby created for establishing a clip connection. By varying the shaft length, moreover, simple adjustability of the securement system to different rotor types is provided. Here it may in principle be provided that the first holder element has a shaft having two or more snap-in noses. This arrangement permits an especially simple adjustment of the forces for clipping-in and unclipping, which may essentially be set independently from one another. For example, a firm and secure connection of the holder elements involving a large unclipping force may thereby be ensured.

Further advantages arise if the clipping receptacle of the second holder element has at least one snap tongue. In this way, the insertion kinematics necessary for clipping or snapping the holder elements, and the associated clipping-in forces, can be adjusted especially simply and precisely. In principle, provision may be made here for each snap-in nose of the first holder element to be associated with a snap tongue of the second holder element.

A second advantageous embodiment of the invention provides that the at least one snap tongue for establishing the clip connection is elastically deformable between a resting position and a deflected position, and/or forms an inclined insertion guide for clipping-in the at least one snap-in nose of the first holder element. As the snap tongue is elastically deformable between a resting position and a deflected position, the snap tongue may be deflected elastically out of the resting position when the snap-in nose is inserted, until the snap-in nose has reached its desired final mounting position and the clip connection has been established. Preferably, after or during the establishment of the clip connection, the snap tongue returns to its resting position. As the at least one snap tongue forms an inclined insertion guide for clipping-in the at least one snap-in nose of the first holder element, the insertion kinematics and clipping-in forces can be adjusted especially simply and precisely, so that a correspondingly simple and fast assembly is made possible.

Simplified assembly is achieved by a further advantageous configuration of the invention in that on its side facing away from the holding portion, the at least one snap-in nose has a rounded and/or tapered insertion contour. An especially precise adjustment of the unclipping force needed for dismantling is achieved alternatively or additionally in that the at least one snap-in nose has on its side facing toward the holding portion a snapping edge forming a predetermined angle with a longitudinal axis of the shaft. For example, provision may be made for the snapping edge of the snap-in nose to extend at a right angle or an acute angle to the longitudinal axis of the shaft, so as to ensure especially large unclipping forces. Provision may furthermore be made that the unclipping forces are set so great that the clip connection cannot be released nondestructively. Conversely, by setting an oblique angle, smaller unclipping forces may be obtained. A mechanically especially stable clip connection that cannot be released nondestructively is achieved in that in the locked-together state, the clipping receptacle engages with an undercut in the snap-in nose.

Further advantages arise if the connecting portion of the second holder element has a recess in which, in the locked-together state of the holder elements, the at least one snap-in nose of the first holder element is arranged. This is a simple design option for defining the final mounting position of the holder elements.

In a further configuration of the invention, a particularly precise adjustability to different geometries of the mounting site is achieved in that the longitudinal axis of the shaft and/or a principal axis of extension of the clipping receptacle form a predetermined angle with a principal axis of extension of the associated holding portion. In this way, the securement system can be adapted especially easily to mounting sites positioned at an angle or not parallel to an axis of rotation of the rotor base.

In a further advantageous configuration of the invention, the connecting portions of the first holder element and of the second holder element have stops corresponding to one another, by means of which a relative movement between the holder elements can be limited. This represents a simply designed and economical option for limiting the relative mobility of the two holder elements and for defining a final mounting position.

A further advantageous embodiment of the invention provides that the connecting portions of the first holder element and of the second holder element are configured such that after being locked together, they can be unclipped only destructively. In this way an especially reliable securement of the rotor blade or a rotor blade segment is achieved without making removal entirely impossible.

In a further configuration of the invention, a mechanically especially stable securement of the rotor blade or rotor blade segment and an especially advantageous flow of forces are achieved in that the holding portion and the connecting portion of the first holder element and/or of the second holder element are essentially L-shaped in their cross section.

A second aspect of the invention relates to a method for securing an attachment portion of at least one rotor blade or rotor blade segment in a mounting site of a rotor base. According to the invention, provision is made in this case that a securement system according to one of the foregoing exemplary embodiments is used, wherein the connecting portions of the holder elements of the securement system are introduced into the mounting site from opposing sides and are locked together in the mounting site while establishing a clip connection, such that in the locked-together state of the connecting portions, the holding portions of the holder elements fasten the attachment portion of the at least one rotor blade or rotor blade segment at the mounting site. In this way, an especially simple, fast and economical assembly of the securement system, as well as a correspondingly simple, fast and economical securing of the rotor blade or rotor blade segment in place, is made possible. For the removal or replacement of the securement system it is sufficient to release the clip connection between the holder elements. In this regard, it may in principle be provided that the two holder elements may be unclipped nondestructively or only destructively. The holder elements now disengaged may then be removed easily from the mounting site and if applicable replaced with new holder elements. In contrast to the background art, removing all the blades from the entire rotor base is unnecessary, thus achieving substantial advantages in time and cost. The securement system may fundamentally be used irrespective of the necessary mounting direction. After the clip connection is established, moreover, the securement system ensures a defined flow of forces. Preferably the securement system is introduced into the mounting site radially below the attachment portion of the rotor blade or rotor blade segment with reference to the axis of rotation of the rotor base. Further resulting features and their advantages can be found from the descriptions of the first aspect of the invention, where advantageous configurations of the first aspect of the invention are to be considered advantageous configurations of the second aspect of the invention, and vice versa.

A third aspect of the invention relates to a rotor, in particular for a thermal gas turbine, having a rotor base, the turbine having at least one mounting site to which an attachment portion of at least one rotor blade or one rotor blade segment is fastened. According to the invention, provision is made in this case that the rotor has at least one securement system according to one of the foregoing exemplary embodiments, by means of which the attachment portion of the at least one rotor blade or rotor blade segment is fastened to the rotor base. In this way an especially easy, fast and economical assembly of the securement system and a correspondingly easy, fast and economical securement of the rotor blade or rotor blade segment in place is made possible. The rotor base may, for example, be configured as a rotor disk or as a rotor ring. Further resulting features and their advantages will be evident from the descriptions of the first and second aspects of the invention, where advantageous configurations of the first and of the second aspects of the invention are to be considered advantageous configurations of the third aspect of the invention, and vice versa.

Further advantages result if the mounting site is configured as an axial mounting opening in a radially outward peripheral region of the rotor base with reference to an axis of rotation of the rotor. In addition to simple assembly, this arrangement also permits a mechanically especially stable connection of the rotor blade(s) or of the rotor blade segment, as the case may be, to the rotor base.

Further features of the invention will be evident from the claims, the exemplary embodiment, and the drawings. The features and combinations of features named above in the description as well as the features and combinations of features named in the exemplary embodiment below are usable not only in the combinations indicated, but also in other combinations without departing from the scope of the invention.

DETAILED DESCRIPTION OF THE DRAWINGS

Figure 1:
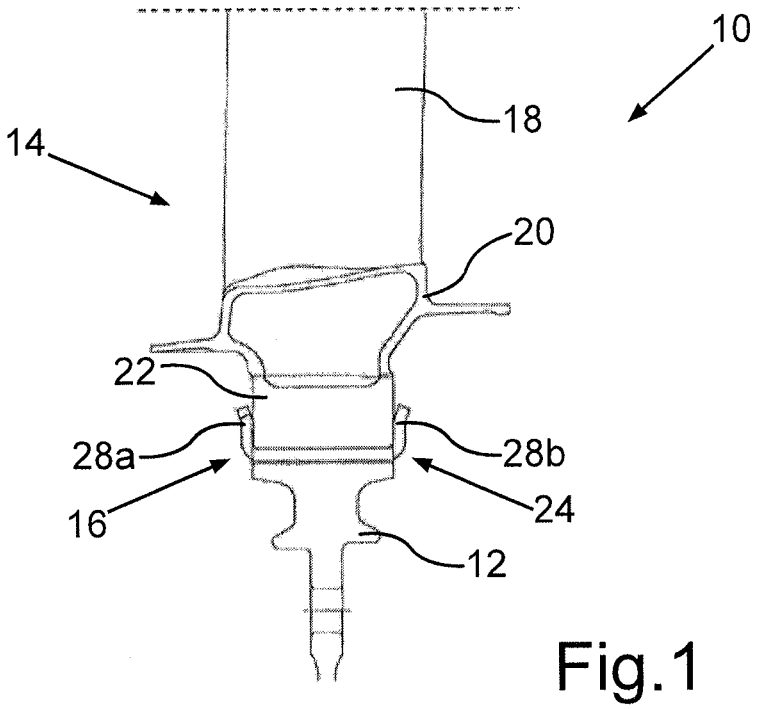
FIG. 1 shows a schematic lateral section of a rotor, to the rotor base of which a rotor blade is attached with the aid of a securement system according to the invention.
Figure 2:
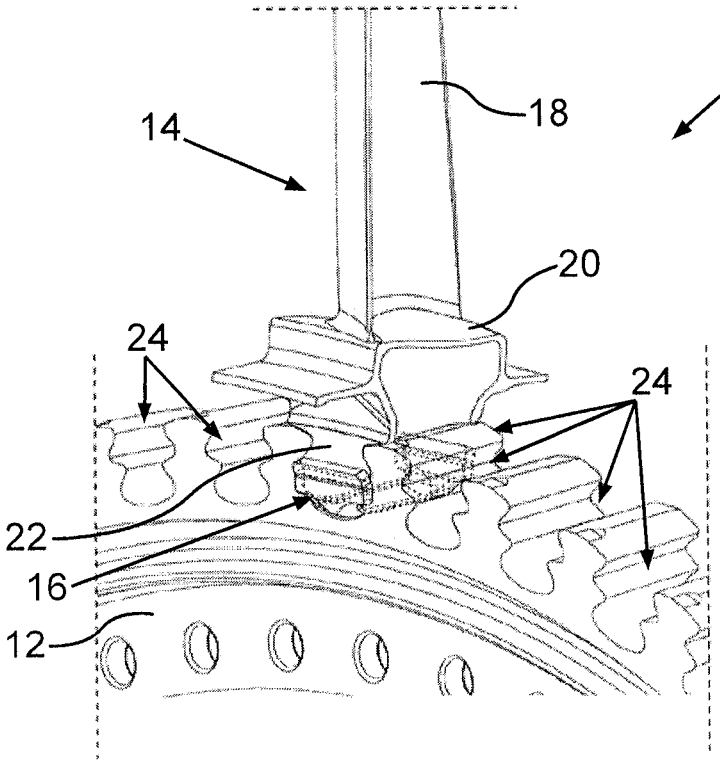
FIG. 2 shows a partially transparent perspective view of the rotor shown in FIG. 1.

FIG. 1 shows a schematic lateral section of a rotor 10 for a thermal gas turbine, for example, for an aircraft engine. FIG. 1 is discussed below as seen in combination with FIG. 2, which shows a schematic and partially transparent perspective view of the rotor 10 shown in FIG. 1. The rotor 10 has a disc-shaped rotor base 12 to which a rotor blade 14 is attached with the aid of a securement system 16 according to the invention. Looking in the radial direction, the rotor blade 14 has a blade portion 18, a blade platform 20 below that, and an attachment portion 22 arranged radially below the blade platform 20 and configured in the present case as a blade foot, being inserted into a mounting site 24 that is in the rotor base 12 and lies axially relative to an axis of rotation of the rotor 10. It can be seen that the securement system 16 is arranged radially below the attachment portion 22 of the rotor blade 14 in the mounting site 24 and grips the attachment portion 22 in a clamp-like manner, such that the rotor blade 14 is fastened to the rotor base 12 on both the front and the back of that base.

Figure 3:
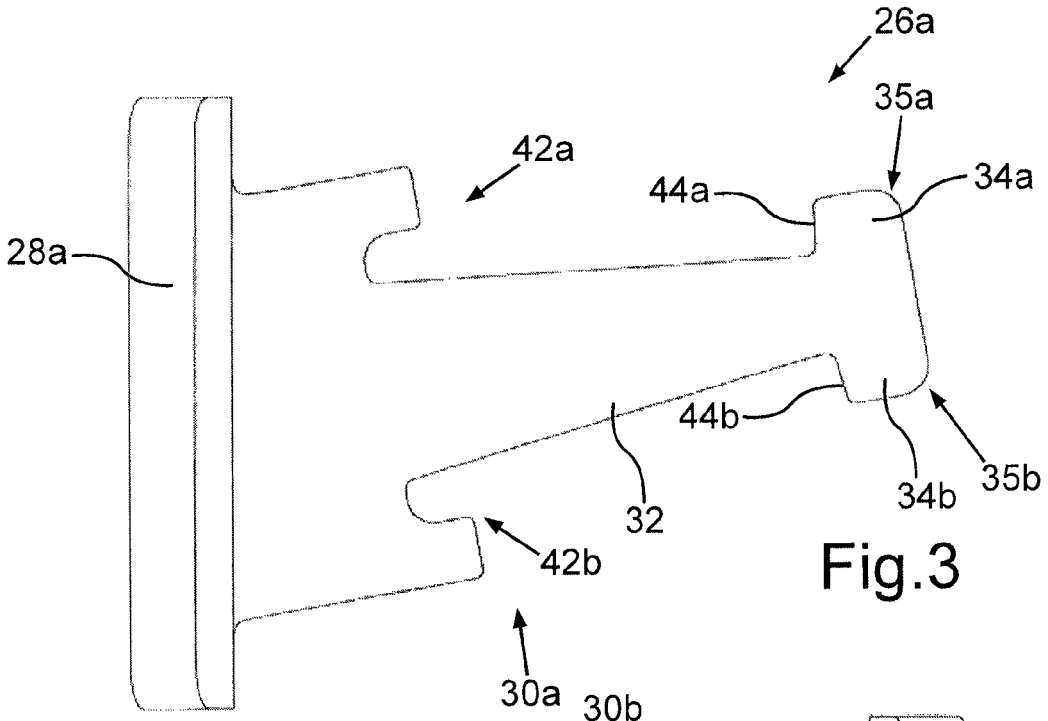
FIG. 3 shows a schematic overhead view of a first holder element of the securement system.
Figure 4:
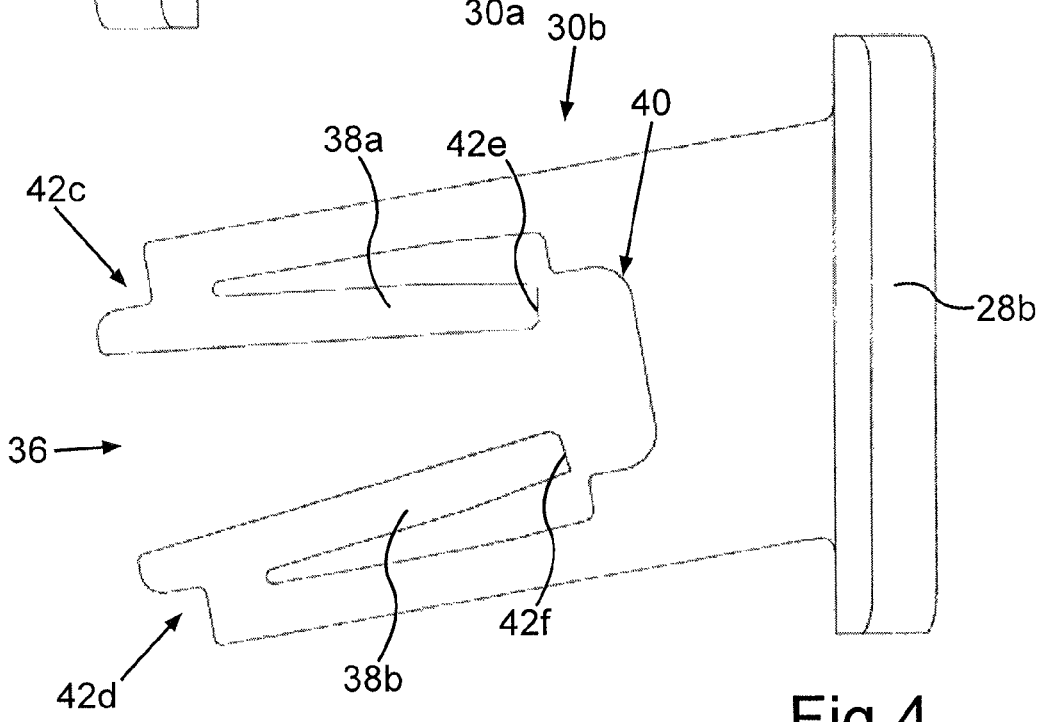
FIG. 4 shows a schematic overhead view of a second holder element of the securement system.

The securement system 16 comprises a first holder element 26*a*, shown in an overhead view in FIG. 3, and a second holder element 26*b*, shown in an overhead view in FIG. 4. Each holder element 26*a*, 26*b* has a holding portion 28*a* and 28*b*, respectively, and a connecting portion 30*a* and 30*b*, respectively, and the connecting portions 30*a*, 30*b* of the holder elements 26*a*, 26*b* are inserted to establish a clip connection, on the one hand from the front, and on the other hand from the back, into the mounting site 24 and are locked together in the mounting site 24, such that the holding portions 28*a*, 28*b* of the holder elements 26*a*, 26*b* secure the attachment portion 22 of the rotor blade 14 (or of a rotor blade segment) in the manner shown in FIG. 1 and FIG. 2 in the mounting site 24. The holding portions 28*a*, 28*b* and the connecting portions 30*a*, 30*b* of the first and second holder elements 26*a*, 26*b* are configured to be essentially L-shaped in cross-section, such that the holding portions 28*a*, 28*b* stand at least approximately perpendicular on the connecting portions 30*a*, 30*b*.

Figure 5:
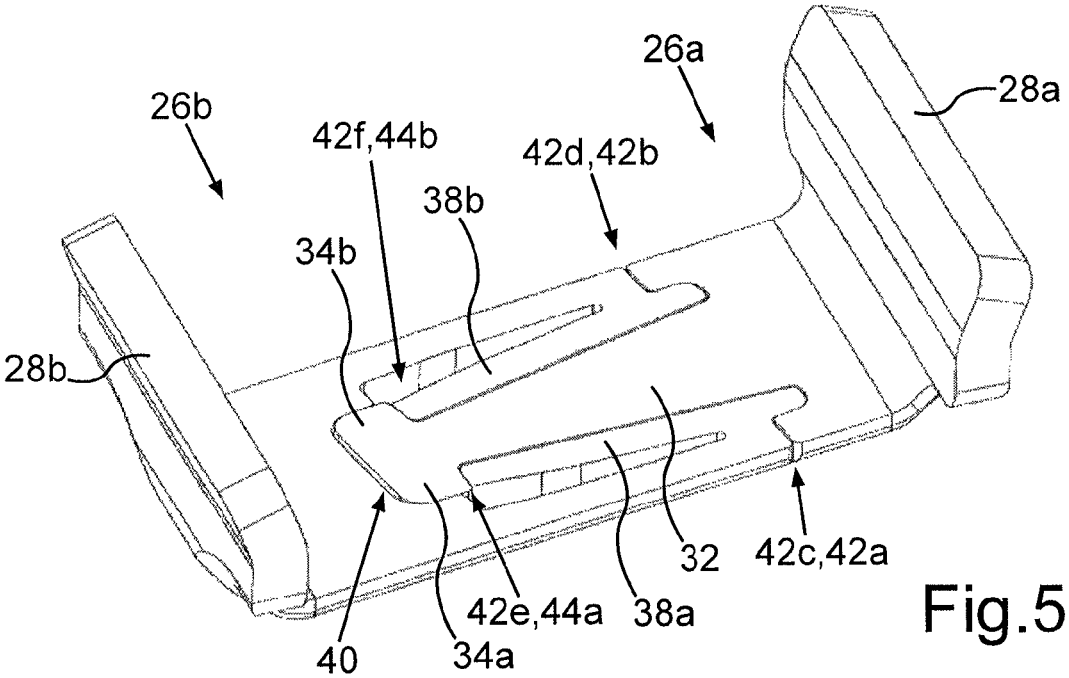
FIG. 5 shows a schematic perspective view of the securement system, wherein the first and second holder elements are locked together.

As can be seen in FIG. 3, the connecting portion 30*a* of the first holder element 26*a* has a shaft 32 with two laterally protruding snap-in noses 34*a*, 34*b*. To establish the clip connection, the connecting portion 30*a* is clipped into an appropriately configured clipping receptacle 36 in the connecting portion 30*b* of the second holder element 26*b*. For further explanation, FIG. 5 shows a schematic perspective view of the securement system 16, in which the first and second holder elements 26*a*, 26*b* are locked together. As can be seen in FIG. 4, the clipping receptacle 36 of the second holder element 26*b* has two snap tongues 38*a*, 38*b*, which serve as inclined insertion guides and are elastically deformed outward from the resting position shown in FIG. 4 when the snap-in noses 34*a*, 34*b* are inserted into the clipping receptacle, until the snap-in noses 34*a*, 34*b* reach their final assembly positions visible in FIG. 5, where they are arranged in a corresponding recess 40 in the connecting portion 30*b*. In FIG. 3 one can see that the snap-in noses 34*a*, 34*b* have rounded insertion contours 35*a*, 35*b* on their sides facing away from the holding portion 28*a* and toward the clipping receptacle 36, thus facilitating insertion into the clipping receptacle 36.

The recess 40 together with the stops 42*a*, 42*b* and the corresponding stops 42*c*, 42*d* of the second holder element 26*b* limits the movement of the first holder element 26*a* into the clipping receptacle 36 of the second holder element 26*b*. In the position of the first holder element 26*a* shown in FIG. 5, the snap tongues 38*a*, 38*b* spring back into their resting position shown in FIG. 4 and together with their internal end portions form stops 42*e*, 42*f* that cooperate with the snapping edges 44*a*, 44*b* of the snap-in noses 34*a*, 34*b* to make movement of the first holder element 26*a* out of clipping receptacle 36 impossible. In the present case the connecting portions 30*a*, 30*b* of the first and second holder elements 26*a*, 26*b* are configured in such a way that after being locked together, they can no longer be unclipped nondestructively. For this purpose, the snapping edges 44*a*, 44*b* form approximately a right angle with a longitudinal axis of the shaft 32. In cooperation with the stops 42*e*, 42*f* on the snap tongues 38*a*, 38*b*, therefore, it is ensured that the necessary unclipping force is so great that before the unclipping force is achieved, a destruction of at least one of the holder elements 26*a*, 26*b* occurs.

As can furthermore be seen in FIG. 3 and FIG. 4, the longitudinal or principal axes of extension of the shaft 32 and of the clipping receptacle 36 do not lie perpendicularly to the principal axes of extension of the respective holding portions 28*a*, 28*b*, but rather, are slightly angled so as to conform better to a geometry of the mounting site 24.

The parameter values indicated in the documentation for the definition of processing and measuring conditions for the characterization of specific characteristics of the subject matter of the invention are to be considered as included in the scope of the invention even within the context of discrepancies, for example because of measurement errors, system errors, weighing errors, DIN tolerances and the like.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A securement system for securing an attachment portion of a rotor blade or an attachment portion of a rotor blade segment in a mounting site of a rotor base, comprising:

a first holder element with a first holding portion and a first connecting portion; and a second holder element with a second holding portion and a second connecting portion;

wherein insertion guides of the second holder element are elastically deformable outward from a resting position by contours of the first connecting portion during introduction of the first and second connecting portions into the mounting site to establish a clip connection in which the first and second holder elements are locked together in the mounting site; and wherein the first and second holding portions are configured so as to fasten the attachment portion of the rotor blade or of the rotor blade segment in the mounting site in a locked state of the first and second connecting portions.

2. The securement system according to claim 1, wherein the first connecting portion has a shaft with a protruding snap-in nose, forming the contours, that is clippable into a clipping receptacle of the second connecting portion so as to establish the clip connection.

3. The securement system according to claim 2, wherein the clipping receptacle has a snap tongue forming one of the insertion guides.

4. The securement system according to claim 3, wherein the snap tongue is elastically deformable between a resting position and a deflected position so as to establish the clip connection.

5. The securement system according to claim 3, wherein at least one of the contours is formed by the snap-in nose on a side away from the first holding portion, and said at least one of the contours is a rounded and/or a tapered insertion contour;

wherein the snap-in nose has, on a side toward the first holding portion, a snapping edge that forms a predetermined angle with a longitudinal axis of the shaft; and wherein in the locked state, the snap tongue engages the snapping edge of the snap-in nose.

6. The securement system according to claim 2, wherein the second connecting portion has a recess in which is arranged the snap-in nose in the locked state.

7. The securement system according to claim 2, wherein a longitudinal axis of the shaft and/or a principal axis of extension of the clipping receptacle are angled to conform to a geometry of said mounting site.

8. The securement system according to claim 1, wherein the first and second connecting portions have stops corresponding with one another, wherein via the stops a relative movement between the first and second holder elements is limitable.

9. The securement system according to claim 1, wherein the first and second connecting portions are configured such that in the locked state the first and second connecting portions can be unlocked only destructively.

10. The securement system according to claim 1, wherein the first holding portion and the first connecting portion and/or the second holding portion and the second connecting portion are configured essentially in an L shape in cross-section.

11. A method for securing an attachment portion of a rotor blade or an attachment portion of a rotor blade segment in a mounting site of a rotor base, comprising the steps of:

fastening the attachment portion of the rotor blade or the rotor blade segment in the mounting site with a first holding portion of a first holder element and a second holding portion of a second holder element by introducing a first connecting portion of the first holder element and a second connecting portion of the second holder element from opposite sides into the mounting site, elastically deforming insertion guides of the second holder element outward from a resting position by contours of the first connecting portion during introduction of the first and second connecting portions into the mounting site, and locking the first and second connecting portions together in the mounting site by establishing a clip connection.

12. A rotor, comprising:

a rotor base, wherein the rotor base has a mounting site;

a rotor blade with an attachment portion or a rotor blade segment with an attachment portion, wherein the attachment portion is fastened in the mounting site by a securement system;

wherein the securement system includes:

a first holder element with a first holding portion and a first connecting portion;

a second holder element with a second holding portion and a second connecting portion;

wherein the first and second connecting portions are disposed in the mounting site and wherein the first and second connecting portions are locked together in the mounting site by outwardly elastically deformable insertion guides of the second holder element moved from a resting position by contours of the first connecting portion during introduction of the first and second connecting portions into the mounting site; and wherein the first and second holding portions grip the attachment portion.

13. The rotor according to claim 12, wherein with reference to an axis of rotation of the rotor, the mounting site is configured as an axial mounting opening in a radially outward peripheral region of the rotor base.

* * * * *